United States Patent [19]

Paliwoda

[11] 4,375,741

[45] Mar. 8, 1983

[54] INSULATION SYSTEM FOR METAL BUILDINGS AND THE LIKE

[75] Inventor: Kenneth J. Paliwoda, Parma, Ohio

[73] Assignee: Metal Building Insulation-Southwest, Inc., Houston, Tex.

[21] Appl. No.: 192,178

[22] Filed: Sep. 29, 1980

[51] Int. Cl.[3] ..... E04B 1/80; E04B 7/02

[52] U.S. Cl. ..... 52/127.1; 52/109; 52/404; 52/407; 52/486; 52/645; 52/695; 52/743; 52/748

[58] Field of Search ..... 52/407, 404, 109, 645, 52/695, 743, 748, 22, 486, 127.1

[56] References Cited

U.S. PATENT DOCUMENTS

| | | | |
|---|---|---|---|
| 1,937,843 | 12/1933 | Randall | 52/407 |
| 2,007,374 | 7/1935 | Kuehne | 52/407 X |
| 2,131,620 | 9/1938 | Garrison et al. | 52/404 |
| 3,121,649 | 2/1964 | Oliver . | |
| 3,155,202 | 11/1964 | Milette | 52/695 X |
| 3,276,171 | 10/1966 | Brown | 52/748 X |
| 3,513,614 | 5/1970 | Studzinski | 52/743 |
| 4,044,521 | 8/1977 | Fischer | 52/404 |
| 4,047,346 | 9/1977 | Alderman | 52/407 |
| 4,075,806 | 2/1978 | Alderman | 52/407 X |
| 4,213,282 | 7/1980 | Heckelsberg | 52/404 |
| 4,263,763 | 4/1981 | Bouwens | 52/404 |

FOREIGN PATENT DOCUMENTS

| | | | |
|---|---|---|---|
| 507934 | 1/1952 | Belgium | 52/404 |
| 553252 | 2/1958 | Canada | 52/748 |
| 2315793 | 10/1974 | Fed. Rep. of Germany | 52/407 |
| 2649339 | 5/1978 | Fed. Rep. of Germany | 52/743 |
| 516892 | 2/1955 | Italy | 52/109 |
| 672297 | 5/1952 | United Kingdom | 52/407 |
| 2006313 | 5/1979 | United Kingdom | 52/407 |

OTHER PUBLICATIONS

Mizell Bros. Co. (a publication) 2/79, 6 pp., 99 Armour Drive, NE, Atlanta, Georgia.

*Primary Examiner*—Alfred C. Perham

*Attorney, Agent, or Firm*—Pearne, Gordon, Session, McCoy & Granger

[57] ABSTRACT

A method and apparatus is disclosed for installing insulation in metal buildings and the like. The apparatus includes a grid supported from the upper flanges of the purlins of the metal building and providing struts and shelves to support an insulation blanket below the upper flanges of the purlins. The shelves support the blanket along its edges and the struts support the blanket at intervals along its length. In accordance with the method, the grids are assembled and then pushed out along the purlins and are dropped down between the purlins while being supported from the upper flanges thereof. With such method, it is not necessary for workmen to work out along the purlins and the grids can be installed while the workmen stand on an end platform on panels of a partially completed roof.

23 Claims, 8 Drawing Figures

INSULATION SYSTEM FOR METAL BUILDINGS AND THE LIKE

BACKGROUND OF THE INVENTION

This invention relates generally to insulation systems and, more particularly, to a novel and improved insulation system for metal buildings and the like and to a novel and improved method of installing the insulation.

Prior Art

Various systems have been used to insulate metal buildings or the like. Such buildings usually include generally Z-shaped purlins which are mounted on the basic building frame and, in turn, support corrugated metal roof panels. One prior art system for providing roof insulation involves the stretching of faced insulation blankets over the purlins and subsequently securing the roof panels to the purlins over the insulation. Such system is described in U.S. Pat. No. 3,121,649. This system cannot be used effectively when relatively thick insulation is required.

When greater thicknesses of insulation are required, systems have been developed which involve the construction of a support network or grid betweeen the purlins. One such system utilizes straps or the like which are stretched through openings formed in the webs of the purlins and, in turn, support the blankets of insulation between the purlins as described in U.S. Pat. No. 4,047,346. In that patent, the support network also includes a wire mesh supportted by straps. Such systems are expensive and time-consuming to install. Holes must be punched in the purlin webs at the proper intervals and the straps must be threaded through such holes and anchored in place. Then, in instances in which the wire mesh is used, the wire mesh must be placed on the straps, and finally the insulation blankets can be installed.

In another system, a hat-shaped support is installed on the purlins to provide shelves along opposite sides of the purlins to support the edges of relatively rigid insulation panels, as described in U.S. Pat. No. 3,513,614. Such system requires the use of a relatively rigid insulation panel which can support itself along opposite edges. This patent also discloses a strip of insulation located between the purlin and the roof panels.

In still another system marketed by Mezell Bros. Co. having an office in Atlanta, Ga., support members formed of sheet metal extend perpendicularly between adjacent purlins and are provided with flanges which rest on the top flange of the purlin. Such support members are placed at intervals along the length of the purlin to support the blankets. This system, like most others discussed above, requires workmen to work out on purlins or on scaffolding constructed below the purlins.

SUMMARY OF THE INVENTION

There are several aspects to the present invention. In accordance with one aspect of the present invention, an improved system is provided for installing insulation of virtually any thickness between the purlins of a metal building in a simplified, economical manner. Shelf means are provided which are supported by the upper flanges of the purlins and provide a shelf extending along the length of the purlins on opposite sides of the web thereof. A grid, consisting of a plurality of elongated struts supported at their ends on opposed shelves, cooperates with the shelves to support an insulation blanket between the webs of adjacent purlins. Such elongated blankets are therefore supported along opposite edges by the shelves and at locations at intervals along their length by the struts.

The spacing between the struts and their arrangement are selected to ensure that the blankets do not excessively sag down between the struts, so that a neat and effective structural system is provided. Preferably, the struts are arranged in an X-like pattern to reduce the tendency for the insulation blanket to sag.

In the illustrated embodiments, the shelf along one side of the purlin web is provided by one support member having a flange which extends between the upper purlin flange and the roofing panels and the opposite shelf is provided by a separate piece which is similarly supported from the upper flange of the purlin.

The two supports are constructed to space the shelves from the roofing panels an appropriate distance for the particular insulation being installed. For example, if 4" insulation is to be installed, the shelves are selected to be spaced from the roof panels by a distance of about four inches. On the other hand, if thicker insulation is required, e.g., 6" insulation, the spacing is appropriately increased. In one embodiment, the support members are provided with flange-engaging webs along their entire length and in another illustrated embodiment, the support members are provided with hanging brackets at intervals along their lengths to reduce the amount of material required to form such suppots.

Blocks of insulation, preferably foam insulation, are positioned over the upper purlin flange and shelf support, and the roof panels are secured on the top of such blocks. Such blocks prevent direct heat conducting contact between the purlins and the roof panels and cooperate with the insulation blankets to provide substantially uninterrupted insulation. Preferably, a metal plate is mounted on the upper side of the insulation blocks to prevent significant denting at the fasteners and to improve the clamping of the roof panels under the heads of the fasteners. Such clamping reduces the tendency for roof blow-off.

In accordance with another aspect of this invention, an improved method of installing insulation is provided. In accordance with this method, the two supports, the struts, and the insulation blocks are separately assembled, for example, on the ground or on a portion of the roof that is completed. In this second embodiment, the assembly is then slid out onto the purlins from one end and dropped into the installed position between the purlins. Since the assembly is completed before it is positioned on the purlins, it is not necessary for the workmen to go out onto the purlins. Instead, the assembled grid is installed by workmen standing on an end platform or on a completed portion of the roof. After the grid is installed, the insulation blankets are merely rolled out along the grid and the roof panels are installed.

The various elements of this embodiment can be nested so that they take very little space for storage and shipment. Further, in the second embodiment both supports are the same, so the assembly requires only three different parts, namely, the shelves, the struts, and the insulation blocks.

DETAILED DESCRIPTION OF THE DRAWINGS

Figure 1:
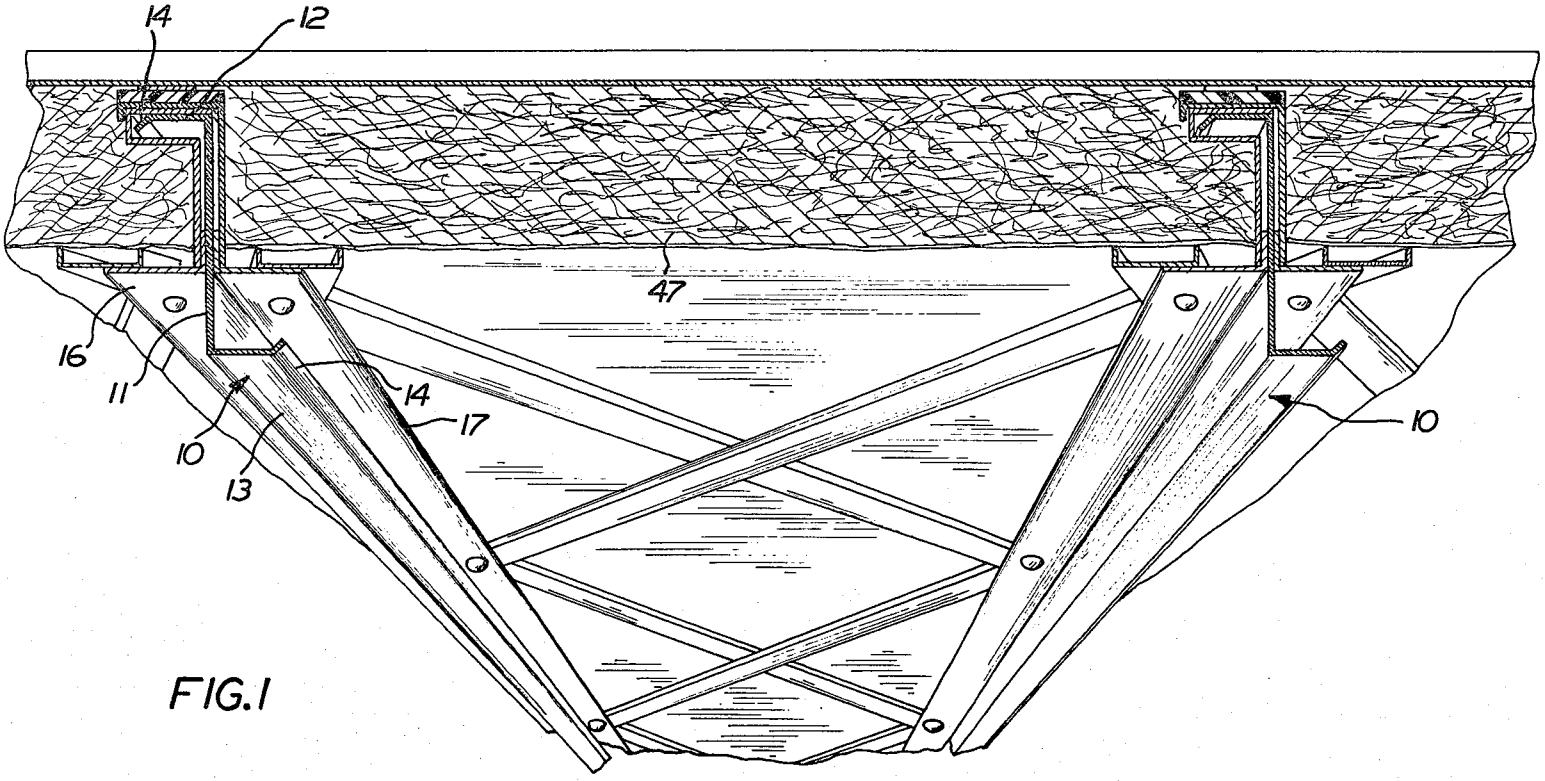
FIG. 1 is a fragmentary, perspective view illustrating the insulation installed in accordance with one embodiment of the present invention in a typical metal building.

FIGS. 1 through 5 illustrate a first embodiment of this invention. As best illustrated in FIG. 1, the roof is supported by Z-shaped purlins 10, which are in turn supported by the main frame system (not illustrated) of the building. Such purlins have a vertically extending web 11, an upper, horizontally extending flange 12, and a lower horizontally extending flange 13. The two flanges 12 and 13 are joined to opposite extremities of the central web 11 and extend in opposite directions therefrom. The flanges are often provided with an angulated edge 14 to increase stiffness.

Figure 2:
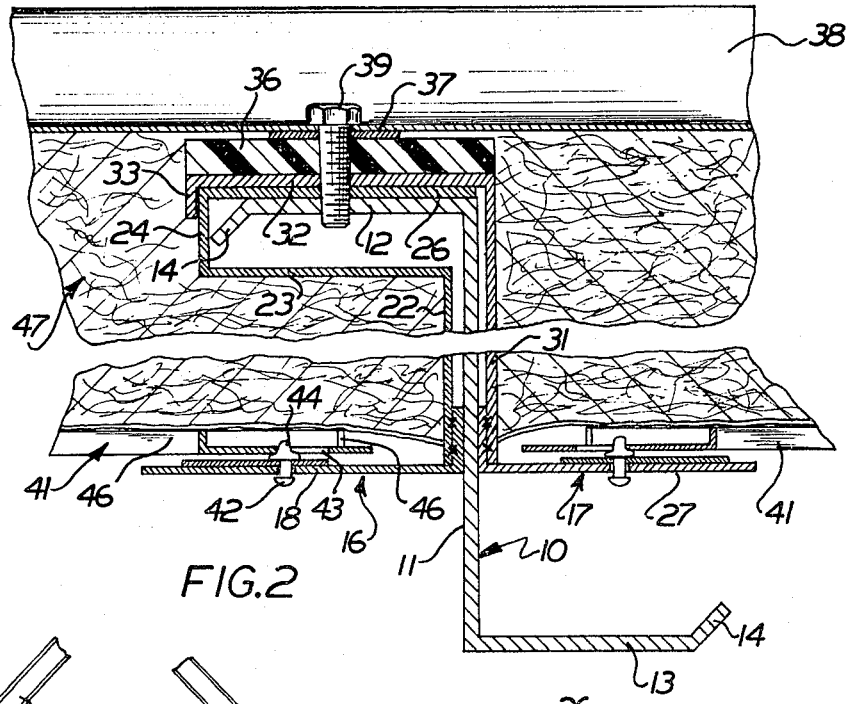
FIG. 2 is an enlarged, fragmentary section illustrating the structural detail of the support system.
Figure 3:
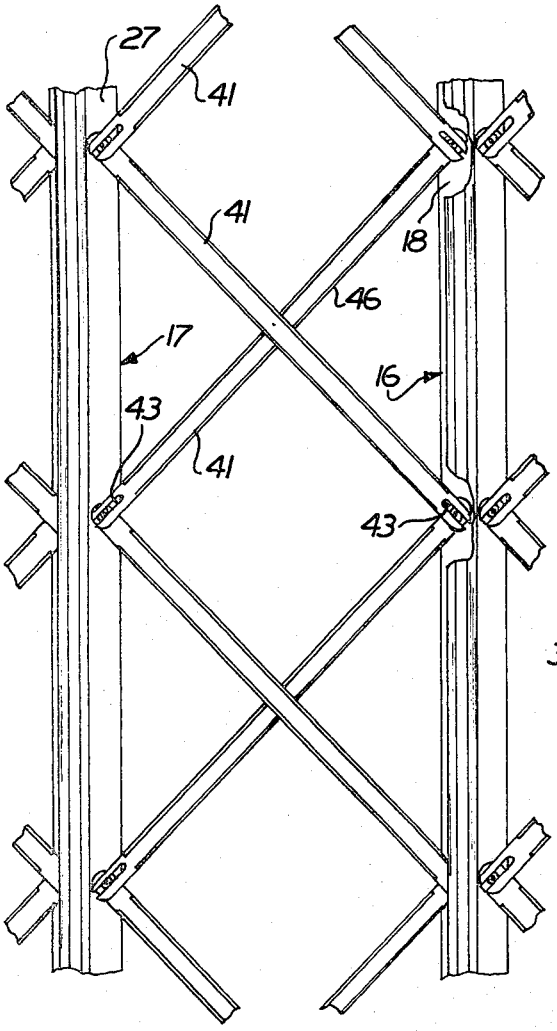
FIG. 3 is a plan view of the installed insulation support grid before the insulation is installed.
Figure 4:
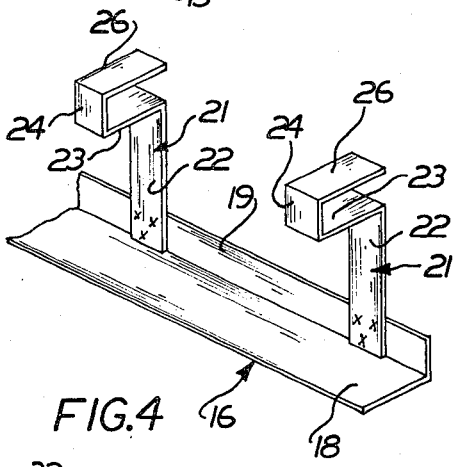
FIG. 4 is a fragmentary, perspective view of one of the support brackets.

Supported from the upper flange 12 are a pair of elongated supports 16 and 17. Referring to FIGS. 2 and 4, the support 16 provides a horizontally extending shelf portion 18 with an upstanding flange 19 at one edge. Secured to the flange 19 at intervals along its length are similar hanger elements 21. Such hanger elements 21 include a vertically extending portion 22 secured to the flange 19 at its lower end by any suitable means such as spot welding or fasteners. At the upper end of the vertically extending portion 21 the hanger provides a horizontally extending portion 23, which extends with clearance below the upper flange 12 of the purlin 10 to a vertical wall portion 23. The vertical wall portion 24 extends up around the end of the flange 12 and joins with a horizontal hanger support portion 26 which engages the upper side of the flange 12 to support the support 16 therefrom.

Figure 5:
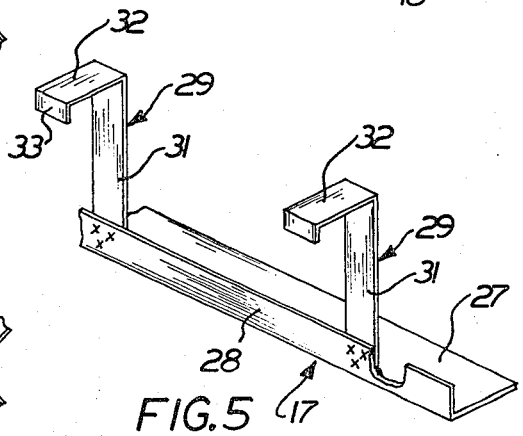
FIG. 5 is a fragmentary, perspective view of the other support bracket.

The structure of the support 17 is best illustrated in FIGS. 2 and 5. This support again includes a horizontally extending shelf portion 27 extending perpendicular to the central web 14 and providing an upstanding flange 28 at its inner edge. Here again, hanger elements 29 are secured to the upstanding flange 28 at intervals along the lenghth of the support 17. These hanger elements include a vertically extending portion 31 secured with spot welds or suitable fasteners at their lower ends to the upstanding flange 28 and extending to a horizontal support portion 32 which is positioned to overlay the upper flange 12 of the purlin 10 to support the support 17. The support portions 32 may overlie the support portions 26 if they are in alignment therewith, or directly engage the upper flange 12 if they are not in alignment. The outer end of the support portion 32 is provided with a downturned flange 33 which engages the vertical wall portion 24 if the hangers are in overlapping relationship, as illustrated in FIG. 2.

Positioned above the support portions 26 and 32, and along the upper surface of the upper flange 12 of the purlin 10 is a block of relatively rigid insulating material 36, formed, for example, of foamed urethane or styrofoam. Extending along the upper surface of the insulating block 36 is a rigid strip of metal 37 which directly engages the roof panels 38. Suitable threaded fasteners 39 extend down through the roof panel 38, the strip of metal 37, the block of foam 36, and into the upper flange 12. If such fasteners are in alignment with the hangers, they also extend through the hangers. However, in many instances, the fasteners are at locations intermediate the hangers, and do not extend therethrough.

A plurality of struts 41 are supported at their ends on the shelf portions 18 and 27. Preferably, the struts 41 are mounted in an X-pattern, best illustrated in FIG. 3, in which they extend diagonally between the two shelf portions 18 and 27. With this pattern of struts, the insulation support grid, consisting of the supports 16 and 17 and the struts 41, provides relatively small openings so that there is no excessive sagging of the insulation blanket when it is installed.

Preferably, the struts 41 are secured at one end by rivets 42 and are formed with slots 43 at their opposite ends which fit over an upstanding projection 44 on the end of the rivet to laterally position such opposite ends. With this structure, the struts are connected by the rivets at one end and positioned along the length of the associated shelf portions 18 and 27 for shipment. Then, when the grid is installed, the strut elements are pivoted over to the opposite shelf element and the slotted portions positioned over the ends of the rivet. The slots 43 are provided to accommodate variations in spacing between the purlins, and in turn the shelf elements. Intermediate their ends, the struts 41 are formed with upstanding flanges 46 to provide a shallow, U-shaped configuration for strength.

After the grid is positioned along the purlins, a faced insulating blanket 47 is rolled out between the purlins and is supported along its edges by the shelf portions 18 and 27, and at spaced locations along its length by the various struts 41. Preferably, the blanket is formed of fiber glass batts having a vapor barrier facing (not illustrated) along the inner surface thereof. Such facing is preferably wider than the batts so that it can be wrapped up over the insulation blocks 36 before the roof panels 38 are installed to provide a substantially continuous vapor barrier in the installed system.

As best illustrated in FIGS. 1 and 2, an insulating system in accordance with this embodiment of the invention provides a substantially continuous or uninterrupted insulation body. Between the purlins, the fiber glass batts of the blankets 47 provide good insulation and over the purlins the blocks of insulation 36 prevent direct conduction between the roof panels and the upper purlin flanges 12.

Preferably, the thickness of the insulation block 36 is selected to provide substantially the same insulation value as provided by the blanket 47. When a foam material, such as styrofoam or urethane foam, is used, a relatively thin insulating block has the same insulation value as a substantially thicker fiber glass blanket. It is therefore preferable to use such insulating materials for the insulating blocks 36.

Since such foam insulating materials can be compressed under load, it is preferable to provide the rigid strip of metal 37 on the upper side of the insulating block 36. This spreads the load of the panels 38 and the fasteners 39 along a substantial surface of the foam materials so that there will be no significant compacting of the foam material. Further, it provides a more solid surface against which the head of the fastener grips the roof panel material to reduce any tendency for the panel to tear out and blow off. Lastly, the metal strip 37 reduces the tendency for roof panel denting to occur when the fasteners 39 are tightened.

With this embodiment, the vertical height of the hangers 21 and 29 is selected to provide a spacing between the two shelf portions 18 and 27 in the roof panels to accommodate the desired thickness of insulation. If, for example, insulation of greater thickness is required, hangers are selected that provide a greater spacing between the shelves and the roof panels. On the other hand, if a lesser thickness of insulation is required, shorter hanger elements are utilized. The hangers, however, are the only portion of the system which would differ for different thicknesses, and it is preferable to inventory the shelf elements and the hangers separately and then connect them together in appropriate sizes to supply the job requirements which are known at that time.

In practice, it is desirable to provide an adhesive along the underside of the blocks of insulation 36 to temporarily retain the blocks in the proper installed position. Similarly, an adhesive is provided between the upper surface of the block and the metal strip 37 to temporarily retain these parts together until they are permanently secured together in the assembled system.

Figure 6:
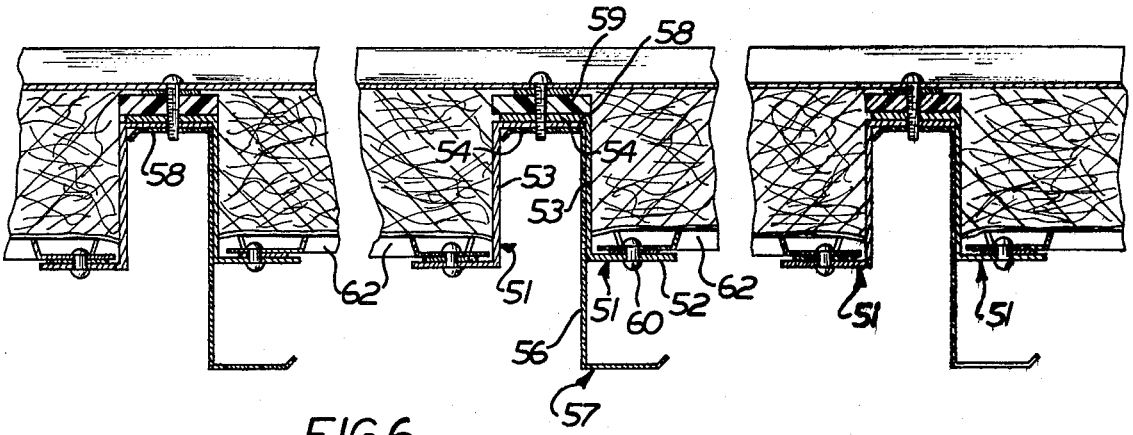
FIG. 6 is a broken vertical section of another embodiment in which the grid is separately assembled and is installed on the purlins by sliding the grid out onto the purlins from one end.
Figure 7:
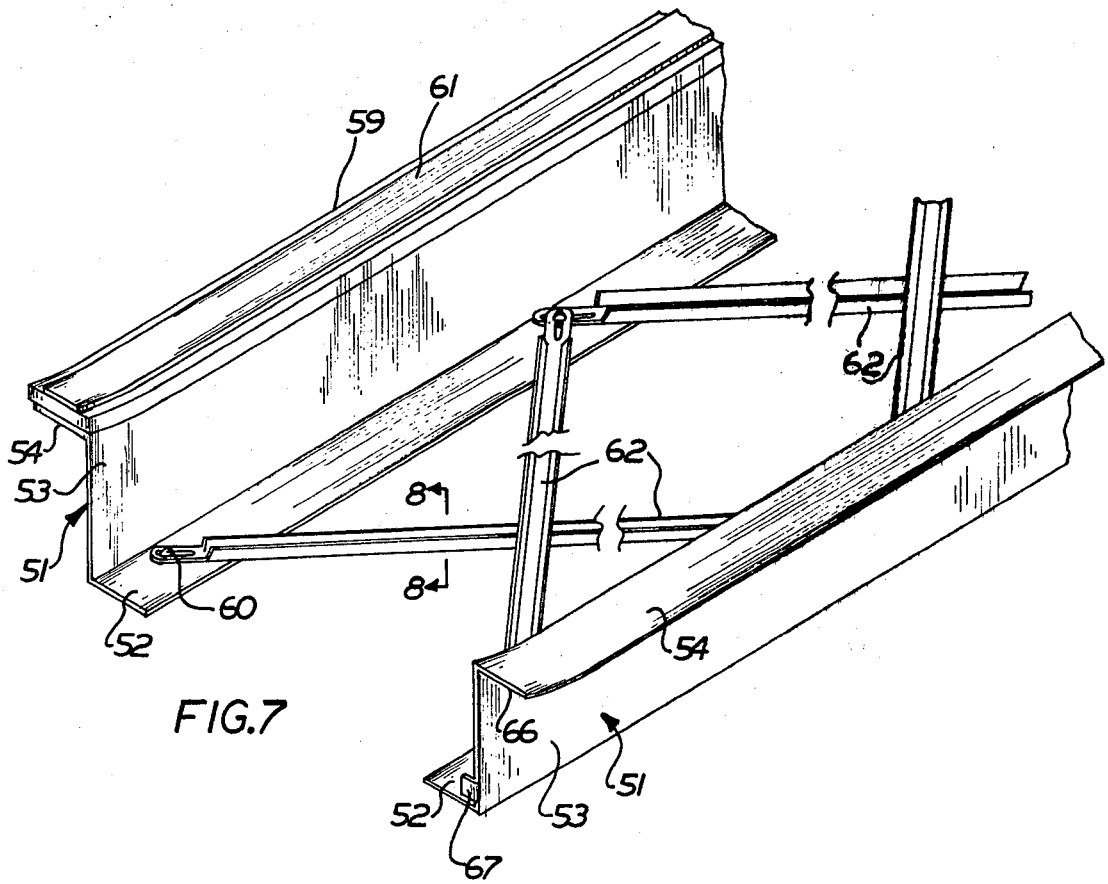
FIG. 7 is a fragmentary, perspective view of the grid of the embodiment of FIG. 6.
Figure 8:
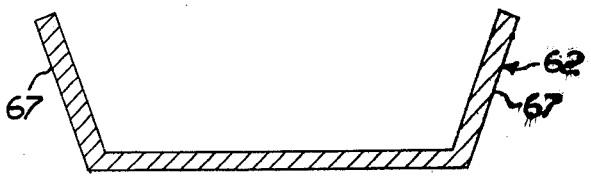
FIG. 8 is an enlarged cross section of the strut taken along line 8—8 of FIG. 7.

FIGS. 6 through 8 illustrate a second embodiment of this invention. In this embodiment, all of the supports 51 have the same shape, and are identical to each other. Here again, the supports 51 provide a lower horizontally extending shelf portion 52, a vertically extending web portion 53 which extends to a horizontally extending support flange 54. As viewed in FIG. 6, the right-hand supports 51 are positioned with their upstanding web portion 53 adjacent to the central web 56 of the metal purlin 57. The left-hand support 51 is positioned with its vertical web portion 53 spaced from the web 56 of the purlin 57 by a distance at least equal to the width of the upper flange 58 of the purlin. Here again, both supports are supported on the upper purlin flange.

Secured to the uppermost support portion 54 is a block of insulating material 59, preferably formed of styrofoam or urethane foam, on which a strip of metal 61 is adhesively secured.

Here again, struts 62 are connected at their ends to the opposed shelf portions 52, preferably in an X-shaped pattern. In this instance, however, a rivet 60 passes through the slotted ends of two struts 62 so that the struts are riveted at both ends to the associated shelf portions 52. If desired, other types of fasteners, such as sheet metal screws, may be used instead of rivets. Preferably, the grid is assembled in a simple jig which provides the proper spacing of the supports for the particular job. The provision of slotted ends permits some adjustment of the spacing between supports.

This grid is assembled at a location spaced from the location where the grid will be installed on the purlins. For example, the grid can be assembled on the ground or on a completed portion of the roof. Because of the X configuration of the struts 62, an assembled grid is stable and can be handled without difficulty.

Because of this stability provided in the assembled grid, and because the two vertical web portions 53 are not spaced apart by a distance greater than the minimum spacing between adjacent purlins, the grid can be installed by merely sliding the grid out along the purlins with one end engaging the purlin and the other end supported by the installer until the grid extends its full length out along the purlins. The rearward end is then dropped down between the purlins to complete its installation. With this structure and method of installation, it is not necessary for a workman to work out along the purlins and the grids can be pushed out along the purlins while the workman stands either on a platform at the end of the building or on the previously installed roof panels.

In order to facilitate the sliding movement of the grid out along the purlins, it is preferable to shape the ends of the supports 51 with an upwardly curved end portion at 66 so that the ends will easily slide over any roughness or edges which might exist along the length of the purlins. It is also desirable to provide a lateral target projection 67 which can be engaged by a similar target projection on the adjacent grid so that more than one grid can be pushed out along the purlins if required.

For example, if the grids are assembled in eight-foot lengths, and if a span of 24 feet is required, a first grid is pushed out along the purlins until it rests between the purlins on the upper flanges thereof. Then, with a pole or a subsequent or second grid, the first grid is pushed further out along the purlins and the second grid is moved out along the purlins behind the first grid, pushing the first grid ahead of it. After the second grid is installed, the third grid is pushed out along the purlins pushing the first and second grids ahead to complete the 24-foot span. Once the grids of the proper span are installed, the insulating blankets are merely rolled out along the grids and the roof panels are installed in the same manner as in the previous embodiment.

In the embodiment of FIG. 6, because the two shelf elements 51 of a given grid have the same shape and size, it is not necessary to manufacture as many different parts. Further, since the shelf elements have a simple Z-shape, they can nest and be stored or shipped in very densely packed packages prior to assembly. In this instance in which nesting is possible, it is preferable to form the struts 62 with diverging flanges 67, as illustrated in FIG. 8, so that the struts 62 can also be nested for storage and shipment.

Preferably, the blocks of insulation 59 with the metal strips adhesively secured to one side are provided with a pressure-sensitive adhesive covered by a release strip on their other side so that they can be secured to the riveted grid to complete the assembly. The separate packaging and shipping of the insulating blocks 59 also reduces shipping volume. Of course, once the insulated roof is installed, the insulation block 59 and the metal strip 61 are mechanically locked together by the fasteners and the adhesive is not depended upon for securing the parts together. Here again, the use of an insulation block 59 above the purlin upper flange provides a cooperation in which full insulation is provided not only between the purlins but also over them. This structure, therefore, eliminates any significant heat conductive metal path. The fact that the ceiling is open underneath the flange 58 of the purlins 57 does not present a problem because of the existence of the insulating block 59 above the flange.

Here again, the metal strip 61 ensures a tight clamping of the roof panel and prevents compacting of the insulation block, thus preventing significant denting of the roofing panels at the fasteners.

Although the preferred embodiments of this invention have been shown and described, it should be understood that various modifications and rearrangements of the parts may be resorted to without departing from the scope of the invention as disclosed and claimed herein.

What is claimed is:

1. An insulated roof comprising spaced and substantially parallel purlins each having an upper flange and a web extending substantially perpendicular thereto, roof panels supported by and secured to said flanges, and support means supported by said flanges and providing a shelf along each side of said web at a location spaced from said flanges, a plurality of struts at intervals along said shelves supported at their ends on opposed shelves, and elongated insulation blankets positioned between said purlins supported along their edges by said shelves and at intervals along their length by said struts, said support means including hangers at spaced locations along the length of said shelves, said hangers providing support portions positioned over said flanges.

2. An insulated roof as set forth in claim 1, wherein a block of insulating material is positioned between said flanges and said roof panels, and said panels are fastened to said flanges by fasteners extending through said block of insulation.

3. An insulated roof as set forth in claim 2, wherein a metal bearing member is positioned between said roof panels and said block of insulation, and said fasteners extend through said bearing member.

4. An insulated roof as set forth in claim 1, wherein said struts are secured at one end to one of said shelves, and provide a slot at the other end positioned over a projection on the other of said shelves to laterally position said other end of said strut on said other shelf.

5. An insulated roof as set forth in claim 4, wherein said hangers are shaped to position said shelves adjacent to said web on opposite sides thereof.

6. An insulated roof system comprising spaced and substantially parallel purlins each having an upper flange and a web extending substantially perpendicular thereto, an elongated grid providing opposed shelves extending lengthwise thereof and a plurality of lateral struts connected at their ends to said opposed shelves in a substantially regular pattern providing openings, separate hanger means supporting each of said shelves providing vertically extending portions and horizontally extending portions overlying said flanges and supporting the associated shelves at a predetermined distance below said flanges, non-rigid, elongated insulation blankets extending lengthwise of said purlins supported along their length at their edges by said shelves and at lateral intervals along their length by said struts, said openings being sufficiently small so that said blankets do not sag excessively between said shelves and said struts, the connections between said struts and said shelves providing said grid with sufficient rigidity so that the grid may be supported at one end by said flanges and at its other end above said flanges for movement out along said purlins to an installed position, said horizontally extending portions at said one end being curved to facilitate sliding movement of said one end along said purlins.

7. An insulated roof system as set forth in claim 6, wherein insulation blocks are mounted on one of said overlying portions along one side of each of said grids, and said one overlying portion on one grid rests on the other overlying portion of the next adjacent grid.

8. An insulated roof as set forth in claim 6, wherein said grids provide lateral targets which are engageable by adjacent grids so that during construction of said roof one grid can be moved along said purlins by an adjacent grid.

9. An insulated roof as set forth in claim 8, wherein blocks of foam insulation or the like are positioned on said support portions on at least one side of said grid.

10. An insulated roof as set forth in claim 9, wherein a strip of metal is positioned between said roof panels and said blocks of insulation.

11. A grid as set forth in claim 1, wherein said struts are in an X-shaped array to rigidify said grid.

12. An insulation support system for roofs having parallel purlins which support roof panels, comprising a pair of supports providing a pair of opposed shelves, a plurality of struts arranged in an X-shaped array and secured at their ends to said shelves and cooperating therewith to provide a stable insulation support grid, each of said supports providing a support projection adapted to overlay the upper surface of an associated purlin and support said shelf from said upper surface at a location below said upper surface, said support system being installable between a pair of purlins by resting one end on said upper surface and sliding it out along said purlins to an installed position.

13. An insulation support system as set forth in claim 12, wherrein the ends of said support projections are upwardly curved to facilitate sliding movement along said purlins.

14. An insulated roof comprising spaced and substantially parallel purlins each having an upper flange and a web extending substantially perpendicular thereto from one edge of said flange, an elongated grid providing opposed shelves extending lengthwise thereof and a plurality of lateral struts connected at their ends to said opposed shelves in a substantially regular pattern providing a plurality of openings spaced along said grid, separate hanger means supporting each shelf providing vertically extending portions and horizontally extending portions overlying said flanges and supporting the associated shelf at a predetermined distance below the associated of said flanges, non-rigid, elongated insulation blankets extending lengthwise of said purlins supported along their entire length at their edges by said shelves and at lateral intervals along their length by said struts, said openings being sufficiently small so that said blankets do not sag excessively between said shelves and said struts, said vertically extending portions being shaped to position said shelves substantially adjacent to the adjacent of said webs with one of said shelves extending under the associated of said flanges, said blankets along said one of said shelves extending under the adjacent flange and substantially to the adjacent web, and roofing secured to said flanges over said insulation.

15. An insulated roof system as set forth in claim 14, wherein blocks of substantially rigid insulation are positioned between said flanges and said roofing, said blocks of insulation having substantially the same insulation value as said blankets.

16. An insulated roof system as set forth in claim 15, wherein strips of metal are positioned on said rigid blocks of insulation only along the upper sides thereof and operate to resist denting of said insulation by said roofing.

17. An insulated roof system as set forth in claim 16, wherein said strips of metal have a lateral width less than the width of said blocks of insulation and are positioned substantially along the centers of said blocks of insulation.

18. A method of installing insulation on metal buildings having spaced parallel purlins comprising assembling an insulation support grid having support portions positioned to overlay the top of an adjacent purlin and support said grid at a location spaced below said top, sliding said support grid out along said purlins to an installed position, placing insulation on said support grid between said purlins, and mounting roof panels on said purlins over said insulation.

19. A method of installing insulation as set forth in claim 18, wherein a block of insulation is secured to the support portion along at least one side of said support grid before installation thereof, and said roof panels are mounted over said block of insulation.

20. A method as set forth in claim 19, wherein said block of insulation is formed of foam material and a metal plate is installed on the upper surface thereof for engagement with said roof panels.

21. A method as set forth in claim 20, wherein said grid is formed of elements which nest with like elements, and said grids are assembled from said elements to form a stable grid before said grid is positioned on said purlins.

22. A method as set forth in claim 18, wherein said grid is formed of elements which nest with like elements, and said grid is assembled from said elements to form a stable grid before said grids are positioned on said purlins.

23. A method as set forth in claim 18, wherein a plurality of grids are pushed out along said purlins in end-to-end relationship before said insulation is installed.

* * * * *